US006526235B2

(12) United States Patent
Kato

(10) Patent No.: US 6,526,235 B2
(45) Date of Patent: Feb. 25, 2003

(54) TONER REPLENISHMENT CONTROL METHOD FOR IMAGE FORMING APPARATUS, AND THE IMAGE FORMING APPARATUS

(75) Inventor: Shinji Kato, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/910,830

(22) Filed: Jul. 24, 2001

(65) Prior Publication Data

US 2002/0044784 A1 Apr. 18, 2002

(30) Foreign Application Priority Data

Jul. 27, 2000 (JP) ..... 2000-227866
Jul. 17, 2001 (JP) ..... 2001-216450

(51) Int. Cl.[7] ..... G03G 15/08
(52) U.S. Cl. ..... 399/27
(58) Field of Search ..... 399/28, 49, 72

(56) References Cited

U.S. PATENT DOCUMENTS 5,327,196 A 7/1994 Kato et al.
5,387,965 A 2/1995 Hasegawa et al.
5,475,476 A 12/1995 Murai et al.
5,682,572 A 10/1997 Murai et al.
5,860,038 A 1/1999 Kato et al.
5,930,571 A 7/1999 Ito
6,055,386 A 4/2000 Kato et al.
6,115,561 A * 9/2000 Fukushima ..... 399/49
6,160,569 A 12/2000 Fujimori et al.

FOREIGN PATENT DOCUMENTS

JP 4-336868 * 11/1992

* cited by examiner

*Primary Examiner*—Quana M. Grainger
(74) *Attorney, Agent, or Firm*—Oblon, Spivak, McClelland, Maier & Neustadt, P.C.

(57) ABSTRACT

A toner replenishment control for an image forming apparatus comprising: determining a second image production condition for a second toner detecting pattern based on a detection result of a toner adhesion amount of a first toner detecting pattern formed on an image carrying body according to a first image production condition; performing toner replenishment control based on a detection result of a toner adhesion amount of the second toner detecting pattern formed by the second image production condition determined as mentioned above, and a toner replenishment control target value; and altering the toner replenishment control target value to be used above based on the detection result of the second toner detecting pattern formed according to the second image production condition.

8 Claims, 10 Drawing Sheets

FIG.11

| NO. | Vmax | $V_D$ | $V_B$ | $V_L$ |
|---|---|---|---|---|
| 1 | 160 | 400 | 260 | 110 |
| 2 | 180 | 429 | 286 | 118 |
| 3 | 200 | 457 | 311 | 126 |
| 4 | 220 | 486 | 337 | 133 |
| 5 | 240 | 514 | 363 | 141 |
| : | : | : | : | : |
| : | : | : | : | : |
| 16 | 460 | 829 | 646 | 226 |
| 17 | 480 | 857 | 671 | 234 |
| 18 | 500 | 886 | 697 | 241 |
| 19 | 520 | 914 | 723 | 249 |
| 20 | 540 | 943 | 749 | 257 |

TONER REPLENISHMENT CONTROL METHOD FOR IMAGE FORMING APPARATUS, AND THE IMAGE FORMING APPARATUS

BACKGROUND OF THE INVENTION

1. Field of the Invention

The present invention generally relates to a toner replenishment control for an image forming apparatus such as a copier, a facsimile machine, a printer or the like, in which a latent-image pattern is formed on an image carrying body, the development characteristic is measured from electric potential information thereof and a toner adhesion amount, and, from the development characteristic, various electric potentials at a time of forming images regularly are determined.

2. Description of the Related Art

In an image forming apparatus such as a copier, a facsimile machine, a printer, or the like, employing an electrostatic photographic method, generally speaking, a photosensitive body drum is rotated by a motor or the like, the photosensitive body drum is uniformly charged by a charging device, then, an electrostatic latent image is formed on the drum as a result of an image being written thereonto through image exposure thereof by an exposure device, the thus-formed electrostatic latent image is developed by a developing device so as to be a toner image, the toner image is then transferred to a transfer material by a transfer device, and the toner image is fixed onto the transfer material by a fixing device.

In the image forming apparatus which forms an image through the above-mentioned electrostatic photographic process, an electrostatic-latent-image electric potential of a test pattern of the electrostatic latent image formed on the photosensitive drum body is measured, the development characteristic is obtained from the toner adhesion amount of the above-mentioned test pattern visualized by toner, and, from this development characteristic, various electric potentials such as a development bias potential and a charging electric potential of the image carrying body (photosensitive body drum) are calculated.

For example, the electrostatic-latent-image electric potential of the test pattern of the electrostatic latent image is measured, the toner adhesion amount of this test pattern of electrostatic latent image visualized by toner is measured, and, then, by using the thus-obtained measurement data, a straight-line approximated formula of the development characteristic, that is, a development $\gamma$ characteristic, is obtained through straight-line approximation. Then, an inclination of this straight-line approximated formula is assumed as being a development efficiency, and, from the development efficiency, the various electric potentials to be used for regular image formation are obtained.

Further, in a normal (regular) image forming occasion, a toner detecting pattern (test pattern) for toner replenishment control is produced every predetermined number of sheets of printing, and a toner replenishment amount is calculated from the detection result of the toner adhesion amount of this toner detecting pattern. For example, the toner detecting pattern is produced in a predetermined image production condition, the detection value of the toner adhesion amount of the toner detecting pattern is compared with a toner replenishment control target value, and, based on this comparison result, a toner amount to be supplied (toner replenishment amount) is determined.

Further, according to the above-mentioned detection result of the (toner) development characteristic, a development potential for producing the above-mentioned toner detecting pattern is lowered when the above-mentioned detection result of the development characteristic is such that the developing performance is judged as being low. As a result, toner adhesion of the toner detecting pattern is made to be such that the toner adhesion is lower than the above-mentioned toner replenishment control target value for the toner detecting pattern, and, thereby, toner replenishment becomes more likely to be actually performed as a result of 'toner low' being detected from the thus-intentionally-lowed toner adhesion of the toner detecting pattern. Thus, restoring of the development performance becomes more likely to be achieved.

However, in the above-described toner replenishment control method, when the development potential for producing the toner detecting pattern for toner replenishment control is altered, a resulting change in toner adhesion amount of the toner detecting pattern may vary according to a characteristic of the used developing agent, mechanical characteristic of the developing device, or environmental conditions. As a result, the toner adhesion amount of the toner detecting pattern may become excessively smaller or larger than an expected value.

In a case where toner replenishment control is performed based on a detection result of toner adhesion amount of the toner detecting pattern in a condition in which the toner detecting pattern is produced by fixed image production conditions, the toner replenishment control is performed such that the toner adhesion amount, in other words, the image density may not vary. However, the image production conditions may be intentionally altered for various reasons.

For example, there is a case where the developing potential is intentionally altered in order to change the toner adhesion amount of the toner detecting pattern so as to change the development performance. Further, in a system in which the image production conditions for the toner detecting pattern are made equal to be the image production conditions for regular image formation (in regular printing operation), the image production conditions for the toner detecting pattern are necessarily altered when the image production conditions for regular image formation are intentionally altered.

In such a case, the thus-altered image production conditions for the toner detecting pattern may result in change in the toner adhesion amount of the toner detecting pattern. However, the amount of change in the toner adhesion amount of the toner detecting pattern may not necessarily become an expected one.

For example, in a case where the toner density is to be increased because the detected development $\gamma$ characteristic is low, the development bias for developing the toner detecting pattern is intentionally lowed by 10 volts so that the development potential is lowered. Then, although the toner replenishment control target value has been equal to the toner adhesion amount of the toner detecting pattern immediately before the change, the toner adhesion amount of the toner detecting pattern may be reduced by an amount more than an expected one. In such a case, toner replenishment is automatically performed until the resulting toner adhesion amount becomes the toner replenishment control target value. For this purpose, the development performance may be excessively increased, and, this may result in undesired variation in density, and/or variation in color of printed images.

Such a problem may occur not only due to the above-mentioned fact that change in toner adhesion amount of the toner detecting pattern resulting from alternation of the development potential may differ due to environmental condition or the like, but also due to variation in the above-mentioned straight-line approximation for the development γ characteristic, bad influence of a degraded control accuracy in a case where the development bias, charging electric potential, or exposure electric potential is made shifted, or the like.

Further, assuming that the toner detecting pattern for toner replenishment control is developed by a fixed development potential, the problem concerning shift of toner adhesion amount occurring by alteration of the development potential is reduced. However, when the charging characteristic of the developing agent varies due to aging and/or environmental variation, toner replenishment control is performed such that the developing amount may be made uniform with respect to the same potential. As a result, the toner density of the developing agent may vary too much, and, thereby, toner scattering, toner sticking, overflow of the developing agent, or the like may occur.

Thus, according to the toner replenishment control system in the related art, especially in a case where this is employed in a full-color copier which is likely affected by its development performance, undesired color variation may occur due to change in development performance. Especially, stability in highlight part of a resulting full-color image may be degraded.

SUMMARY OF THE INVENTION

An object of the present invention is to provide a toner replenishment control system by which the above-mentioned problems are solved, and, thereby, stable image density of a printed image can be maintained.

A toner replenishment control for an image forming apparatus comprising:

a) determining a second image production condition for a second toner detecting pattern based on a detection result of a toner adhesion amount of a first toner detecting pattern formed on an image carrying body according to a first image production condition;

b) performing toner replenishment control based on a detection result of a toner adhesion amount of the second toner detecting pattern formed by the second image production condition determined as mentioned above, and a toner replenishment control target value; and c) altering the toner replenishment control target value to be used above based on the detection result of the second toner detecting pattern formed according to the second image production condition.

Thereby, when the image production condition is intentionally altered, the toner replenishment control target value is renewed based on a detection result of a toner adhesion amount of a toner detecting pattern formed according to the thus-altered image production condition. Accordingly, it is possible to effectively prevent an excessively large or excessively small control amount in toner replenishment control from being adopted. Thereby, it is possible to maintain an image density of printed image even through repetitive operations of toner replenishment control.

The above-described control process may further include correcting the above-mentioned alteration of the toner replenishment control target value, based on a current development performance (γ performance/characteristic).

Thereby, it is possible to determine the toner replenishment control target value such that the toner replenishment amount may be increased as the development γ performance becomes lower, and, also, the toner replenishment amount may be decreased as the development γ performance becomes higher. As a result, the toner density in image development is properly adjusted, and, thus, it is possible to maintain a stable image density (printed image density) even over long operation of the image forming apparatus.

In the above-described control process, the toner replenishment control target value may be determined to be within a range in which a toner adhesion sensor for detecting for the first and second toner detecting patterns can have a proper sensitivity.

Thereby, it is possible to prevent the toner replenishment control from having run away due to occurrence of a possible extreme value of toner replenishment control target value. Accordingly, it is possible to perform high-reliability toner replenishment control.

In the above-described control process, the image production condition for the second toner detecting pattern may be the same as an image production condition for regular image formation performed.

Thereby, there is no necessity to perform complicated control such as switching of a charging bias, development bias, and so forth, especially for producing an image of the toner detecting pattern. Also, the toner detecting pattern may be made smaller. Accordingly, the toner consumption can be effectively reduced, and, high efficiency can be achieved in image formation.

Other objects and further features of the present invention will become more apparent from the following detailed description when read in conjunction with the accompanying drawings.

BRIEF DESCRIPTION OF THE DRAWINGS

FIG. 11 illustrates values of respective control voltages stored in a ROM shown in FIG. 2.

DESCRIPTION OF THE PREFERRED EMBODIMENTS

Embodiments of the present invention will now be described.

Figure 1:
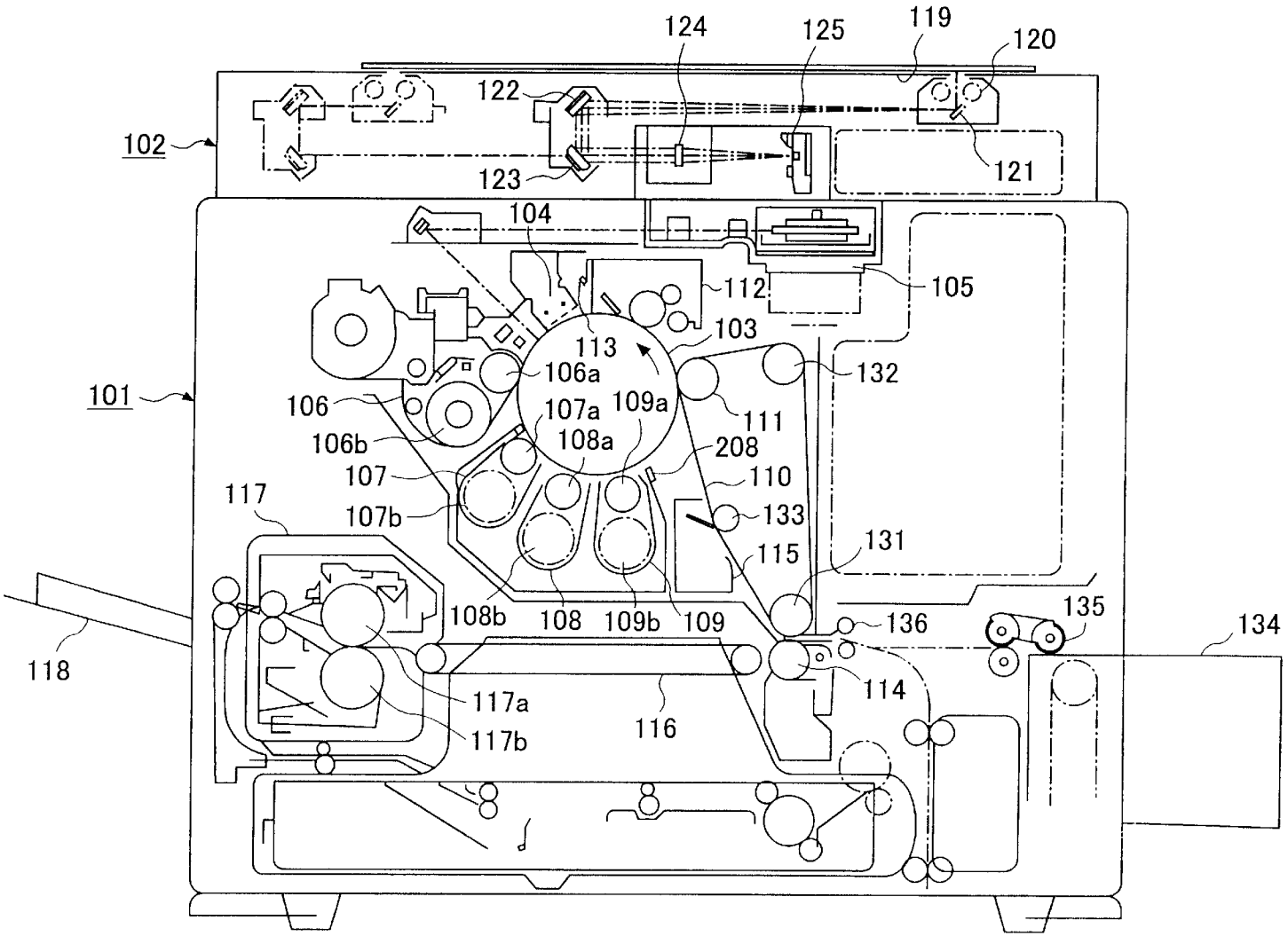
FIG. 1 shows a side elevational sectional view of an image forming apparatus according to the present invention.

FIG. 1 shows a side-elevational sectional view of essential part of a full-color copier in each of the embodiments of the present invention. This full-color copier is one example of an image forming apparatus performing an electrophotographic process.

In the figure, the full-color copier includes a color printer part 101 which is an electrophotographic printer, and a color image reading device (simply referred to as a 'color scanner', hereinafter) 102.

In the color scanner 102, an original sheet placed on an original placement table 119 made of a contact glass is irradiated by a light source 120, reflected light therefrom is imaged onto a color sensor 125 through an optical system of reflective mirrors 121, 122, 123 and an imaging lens 124, and thus-obtained color image information is then decomposed into blue, green and red components, for example, and is read, and, thus, is converted into respective electric image signals.

The above-mentioned color sensor 125 includes a color decomposing unit which decomposes the original color image information into blue, green and red components, and a CCD which is a photoelectric device converting the thus-decomposed image information of the respective color components into the respective electric image signals. Thereby, image reading is performed for these three color components in a same manner.

The thus-obtained color-decomposed image signals of blue, green and red components from the color sensor 125 undergo color converting processing based on the intensity levels thereof by an image processing unit not shown in the figure, and, thus, are converted into color image data of black (BK), cyan (C), magenta (M) and yellow (Y) components.

The color printer part 101 forms visualized images of Bk, C, M and Y components from the color image data provided by the image processing unit, and, therefrom, forms a final color image (printed image).

The color scanner 102 scans the original sheet placed on the original placement table 119 as a result of an exposure lamp 120 and the reflective mirrors 121, 122 and 123 being moved leftward in predetermined timing according to operation of the color printer part 101, and, thus, the image data for one color component is obtained through one original scanning operation. Then, through repetition of such an operation four times total by the color scanner 102, the image processing unit obtains the image data of the four color components of BK, C, M and Y, respectively. Then, each time the image processing unit obtains each color-component image data, the color printer part 101 forms a visualized image thereof in sequence, and, as a result of thus-obtained visualized images being superimposed, four-color full-color image is formed.

In the color printer part 101, a photosensitive body drum 102 acting as an image carrying body is stopped during a copy standby occasion in which no image is formed thereon, and is rotated by a main motor during a copying occasion in which an image is formed thereon. Then, image exposure for respective color components of BK, C, M and Y is performed through laser irradiation by a laser optical system 105 which is an exposure unit for each rotation of the drum after the photosensitive body drum 103 is uniformly charged by an electrification charger 104. Thus, electrostatic latent images of the respective color components are formed thereon, in sequence. Further, the laser optical system 105 converts the color image data from the image processing unit into optical signals, performs optical writing on the photosensitive body drum 103 corresponding to the original image, and thus, forming the electrostatic latent images thereon. This laser optical system 105 includes a laser, a light-emitting driving control unit which controls light emission of the laser, a polygon mirror, a motor rotating the polygon mirror, an f/θ lens, and a reflective mirror.

The laser performs light emission according to the color image data under control by the light-emission driving control unit, and thus-generated laser beam is deflected by the polygon mirror, and is applied to the photosensitive body drum 103 through the f/θ lens and reflective mirror.

As shown in the figure, the photosensitive body drum 103 is rotated counterclockwise. Around the photosensitive body drum 103, a cleaning device 112, an electricity removal lamp 113, an electrification charger 104, a BK developing device 106, a C developing device 107, an M developing device 108, a Y developing device 109, a reflection density sensor 208 acting as a toner adhesion amount detection sensor, an intermediate transfer belt 110 and so forth are disposed.

The respective developing devices 106 through 109 include developing sleeves 106*a*, 107*a*, 108*a* and 109*a* rotating and causing ears of the development agents to come into contact with the photosensitive body drum 103 so as to form the electrostatic latent images thereon; developing paddles 106*b*, 107*b*, 108*b* and 109*b* rotating so as to draw and stir the internal development agents, and so forth.

In a standby state, in all of the four developing devices 106 through 109, the development agents on the developing sleeves 106*a* through 109*a* are in an ear broken (development disabled) state. The order (the order of respective image forming operations of BK, C, M, Y) of respective developing operations of the developing devices 106 through 109 is such that the electrostatic latent images of BK, C, M and Y are formed in the stated order. However, the order of the image forming operations of the respective color components is not limited thereto, and, may be any order. Further, at starting of copying operation, the photosensitive body drum 103 is rotated, and is charged uniformly by the charger 104. Then, the color scanner 102 starts reading for obtaining BK image data at a predetermined timing, and, the laser optical system 105 performs optical writing onto the photosensitive body drum 103 by the laser beam based on the BK image data given by the color scanner through the image processing unit, and, thus, forms a latent image thereof thereon.

The electrostatic latent image produced based on the BK image data will be referred to as the BK latent image, hereinafter.

Similarly, electrostatic latent images produced based on the respective C, M, Y image data will be referred to as a C latent image, an M latent image and a Y latent image, respective, hereinafter.

Then, in order to visualize this BK latent image from an end part thereof, the developing sleeve 106*a* starts rotation before the leading edge of the latent image reaches a developing position of the BK developing device 106 through the rotation of the drum so as to cause the development agent to come into ears, and the BK latent image is developed thereby. Then, developing operation for a BK-latent-image area of the photosensitive body drum is continued.

When the tail edge of the latent image has passed through the BK developing position, the ears of the development agent on the developing sleeve 106*a* of the BK developing device 106 are made broken so that the Bk developing position becomes into the development disabled state.

This operation is finished before the leading edge of the subsequent C latent image reaches there. The breakage of the ears of the development agent is achieved through switching of the rotation direction of the developing sleeve 106*a* into the reverse direction. At this time, the other developing devices 107 through 109 are still maintained in the development disabled state.

Then, the thus-obtained BK toner image on the photosensitive body drum 103 is transferred onto a surface of the intermediate transfer belt 110 which is driven at a velocity equal to that of the photosensitive body drum 103 (hereinafter, transfer of a toner image from the photosensitive body drum 103 onto the intermediate transfer belt 110 will be simply referred to as belt transfer).

The belt transfer is achieved through application of a predetermined bias voltage to a belt transfer bias roller 111 in contact with the intermediate transfer belt 110 in a state in which the photosensitive body drum 103 is in contact with the intermediate transfer belt 110.

The photosensitive body drum 103 is cleaned by the cleaning device 112, after the belt transfer of the BK toner image, has the electricity thereof removed by the electricity removal lamp 113, and, then, is charged uniformly by the charging device 104 again.

The intermediate transfer belt 110 has the respective BK, C, M and Y toner images, which have been formed on the photosensitive body drum 103 in sequence, transferred onto the same surface part thereof through positioning, and, thereby, has a belt transfer image having the four color components superimposed each other formed thereon. Then, as will be described later, this belt transfer image is transferred to a transfer paper used as a transfer member, collectively.

For the photosensitive body drum 103, the C image forming process is started subsequent to the above-described BK image forming process. In the C image forming process, the color scanner 102 starts reading for obtaining C image data at a predetermined timing, and, the laser optical system 105 performs optical writing onto the photosensitive body drum 103 by the laser beam based on the C image data given by the color scanner through the image processing unit, and, thus, forms the C latent image thereon.

The developing sleeve 107*a* of the C developing device 107 starts rotation after the previous Bk latent image tail edge has passed through and before the leading edge of the C latent image reaches a developing position of the C developing device 107 so as to cause the development agent to come into ears, and the C latent image is developed thereby using the C toner.

Then, developing operation for a C-latent-image area of the photosensitive body drum 103 is continued. When the tail edge of the latent image has passed through the C developing position, same as in the above-mentioned case of the BK developing device 106, the ears of the development agent on the developing sleeve 107*a* of the C developing device 107 are made broken so that the C developing position becomes into the development disabled state.

This operation is also finished before the leading edge of the subsequent M latent image reaches there.

The thus-obtained C toner image on the photosensitive body drum 103 is transferred onto the surface of the intermediate transfer belt 110 which is driven at the velocity equal to that of the photosensitive body drum 103.

The photosensitive body drum 103 is cleaned by the cleaning device 112, after the belt transfer of the C toner image, has the electricity thereof removed by the electricity removal lamp 113, and, then, is charged uniformly by the charging device 104 again.

For the photosensitive body drum 103, the M image forming process is started subsequent to the above-described C image forming process. In the M image forming process, the color scanner 102 starts reading for obtaining M image data at a predetermined timing, and, the laser optical system 105 performs optical writing onto the photosensitive body drum 103 by the laser beam based on the M image data given by the color scanner through the image processing unit, and, thus, forms the M latent image thereon.

The developing sleeve 108*a* of the M developing device 108 starts rotation after the previous C latent image tail edge has passed through and before the leading edge of the M latent image reaches a developing position of the M developing device 108 so as to cause the development agent to come into ears, and the M latent image is developed thereby using the M toner.

Then, developing operation for a M-latent-image area of the photosensitive body drum 103 is continued. When the tail edge of the latent image has passed through the M developing position, same as in the above-mentioned case of the C developing device 107, the ears of the development agent on the developing sleeve 108*a* of the M developing device 108 are made broken so that the M developing position becomes into the development disabled state.

This operation is also finished before the leading edge of the subsequent Y latent image reaches there.

The thus-obtained M toner image on the photosensitive body drum 103 is transferred onto the surface of the intermediate transfer belt 110 which is driven at the velocity equal to that of the photosensitive body drum 103.

The photosensitive body drum 103 is cleaned by the cleaning device 112, after the belt transfer of the M toner image, has the electricity thereof removed by the electricity removal lamp 113, and, then, is charged uniformly by the charging device 104 again.

Then, for the photosensitive body drum 103, the Y image forming process is started subsequent to the above-described M image forming process. In the Y image forming process, the color scanner 102 starts reading for obtaining Y image data at a predetermined timing, and, the laser optical system 105 performs optical writing onto the photosensitive body drum 103 by the laser beam based on the Y image data given by the color scanner through the image processing unit, and, thus, forms the Y latent image thereon.

The developing sleeve 109*a* of the Y developing device 109 starts rotation after the previous M latent image tail edge has passed through and before the leading edge of the Y latent image reaches a developing position of the Y developing device 109 so as to cause the development agent to come into ears, and the Y latent image is developed thereby using the Y toner.

Then, developing operation for a Y-latent-image area of the photosensitive body drum 103 is continued. When the tail edge of the latent image has passed through the Y developing position, same as in the above-mentioned case of the M developing device 108, the ears of the development agent on the developing sleeve 109*a* of the Y developing device 109 are made broken so that the Y developing position becomes into the development disabled state.

The thus-obtained Y toner image on the photosensitive body drum 103 is transferred onto the surface of the intermediate transfer belt 110.

The intermediate transfer belt 110 is laid on a driving roller 131, a belt transfer bias roller 111 and following rollers 132, 133, and, has the transfer bias voltage applied thereto by a power supply circuit through the belt transfer bias roller 111.

The intermediate transfer belt 110 is rotated as a result of the driving roller being driven by a driving motor, not shown in the figure.

A belt cleaning device 115 includes a rubber blade and a contact/removal mechanism for the intermediate transfer belt 110, and, the rubber blade is removed from the intermediate transfer belt 110 by the contact/removal mechanism during an occasion of belt transfer of the C image, M image and Y image after the first BK image is belt-transferred.

A paper transfer bias roller 114 is removed from the intermediate transfer belt 110 normally, comes into contact with the intermediate transfer belt 110 as a result of being pressed by a contact/removal mechanism in timing when the four-color-component superimposed image is collectively transferred onto the paper, and, a predetermined bias voltage is applied to the paper transfer bias roller 114 by the power supply circuit so that the four-color-component superimposed image is transferred onto the transfer paper passing between the paper transfer bias roller 114 and intermediate transfer belt 110.

At this time, the transfer paper is fed to a registration roller 136 from a paper feeding device 134 including a transfer paper cassette through a paper supply roller 135, and, the registration roller 136 supplies the transfer paper at a timing at which the leading edge of the four-color-component superimposed image reaches the paper transfer position.

The transfer paper having had the four-color-component superimposed image transferred thereto collectively is conveyed into a fixing device 117 by a conveying device including a conveyance belt, and, this toner image is fixed onto the transfer paper as a result of heating and pressing by a fixing roller 117*a* having the temperature thereof controlled and a pressing roller 117*b*, and, then, the transfer paper is conveyed out into a paper ejecting tray 118 as a full-color copy.

The photosensitive body drum 103 having undergone the belt transfer has the surface thereof cleaned by the cleaner 112. In an occasion of repeat copy in which copies are produced successively, the operation of the color scanner 102 and image formation onto the photosensitive body drum 103 are started immediately after the Y (fourth color component) image producing process of the first copy. Then, according to a predetermined timing, a BK (first color component) image producing process for the subsequent copy is started.

Further, the intermediate transfer belt 110 has the surface thereof cleaned by the cleaning device 115 immediately after the process of collectively transfer of the four-color-component superimposed image into the transfer paper, and, has a BK toner image of the subsequent copy belt-transferred thereto. Then, operations similar to those of the first copy is performed, and, similar operations will be performed for each copy.

Figure 2:
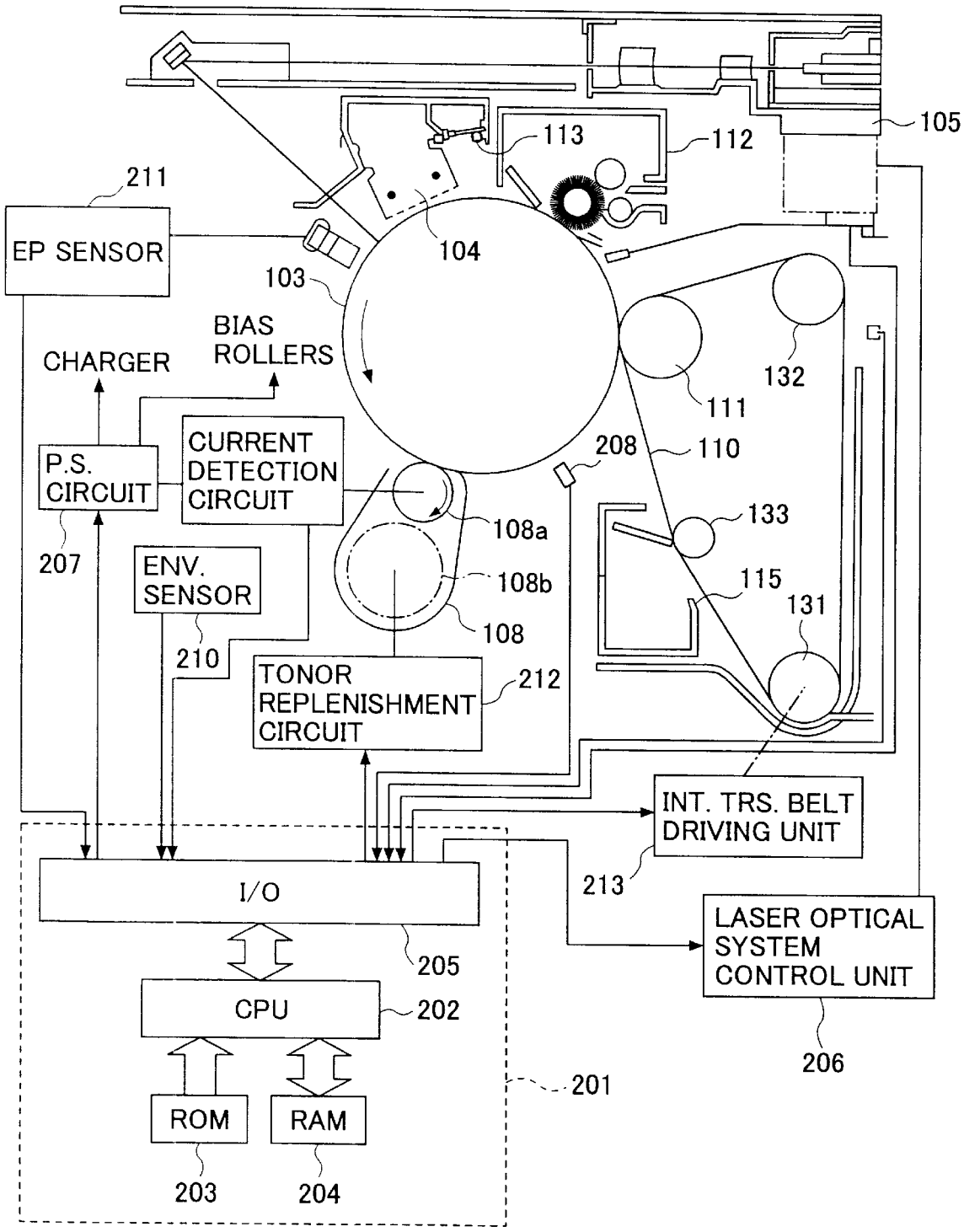
FIG. 2 shows a configuration of an essential part of the image forming apparatus shown in FIG. 1.

FIG. 2 shows a control system included in the above-described copier. This control system includes a main control part 201 and a plurality of peripheral control units. The main control part 201 includes a CPU 202, a ROM 203 storing therein control programs and various data, a RAM 204 used as a work are and storing therein various data temporarily, and an I/O interface part 205 which performs input/output of the respective peripheral control units and so forth.

To the main control part 201, the laser optical system control unit 206, power supply circuit 207, reflection density sensor 208, environment sensor 210, surface electric potential sensor 211, a toner replenishment circuit 212, intermediate transfer belt driving unit 213 and so forth are connected, through the I/O interface part 205.

The laser optical system control unit 206 controls the laser optical system 105 based on instructions given by the CPU 202. The power supply circuit 207, based on instructions given by the CPU 202, applies a high voltage to the electrification charger 104, applies the transfer bias voltages to the transfer bias roller 111 and paper transfer bias roller 114, also, applies developing bias voltages to the respective developing rollers 106*a* through 109*a*.

The reflection density sensor 208 optically detects a reflection density of a toner image on the photosensitive body drum 103 between the Y developing device 109 and intermediate transfer belt 110. The environment sensor 210 detects the ambient temperature and humidity. The surface electric potential sensor 211 detects the surface electric potential of the photosensitive body drum 103 between the electrification charger 104 and BK developing device 106.

Further, the toner replenishment circuit 212, based on instructions given by the CPU 202, causes an M toner replenishment unit to supply magenta toner to the M developing device 108, and, similarly, a plurality of toner replenishment circuits, not shown in the figure, based on instructions given by the CPU 202, cause a BK toner replenishment unit, a C toner replenishment unit and a Y tone replenishment unit to supply black toner, cyan toner and yellow toner to the BK developing device 106, C developing device 107 and Y developing device 109, respectively.

The intermediate transfer belt driving unit 213, based on instructions given by the CPU 202, drives the driving roller 131 and rotates the intermediate transfer belt 110.

Figure 3:
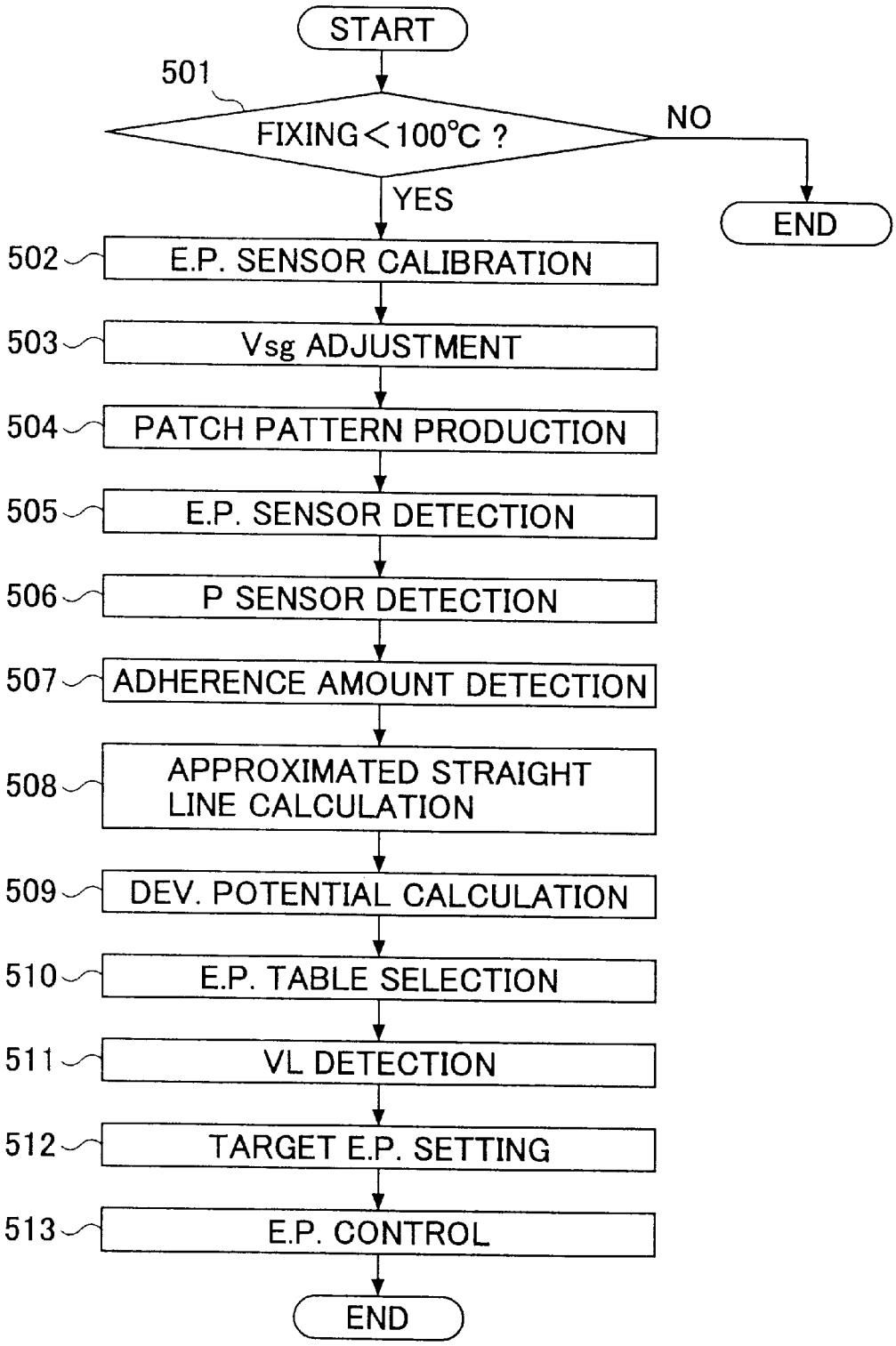
FIG. 3 shows a flow chart of electric potential control performed by a main control part shown in FIG. 2.

FIG. 3 shows a flow chart illustrating an electric potential control routine of the main control part 201. In the electric potential control routine, in order to distinguish a state in power ON from occasions of abnormality processing such as paper jam removal processing, determines, based on an input signal from a fixing temperature sensor for detecting a fixing temperature of the fixing device 117, whether or not the fixing temperature exceeds 100° C., in a step 501.

When the fixing temperature of the fixing device 117 exceeds 100° C., it is determined that abnormality has occurred, and, control of electric potential is not performed.

In the present embodiment, the control of electric potential is performed basically when the apparatus is started up. However, it is also possible to perform the control of electric potential every predetermined number of copies, or every predetermined duration, as the necessary arises.

The control of electric potential will now be described. When the fixing temperature of the fixing device 117 does not exceed 100° C., the main control part 201 performs calibration of the surface electric potential sensor 211 by applying a reference electric potential as the development bias electric potential to the developing roller 106*a* by the power supply circuit 207 in a step 502, and, after that, the thus-calibrated value is used for calculation of electric potentials.

Then, in Vsg adjustment in a step 503, the main control part 201 takes an output value of the reflection density sensor 208 for a background part of the photosensitive body drum 103 and adjusts a light-emitting intensity of the reflection density sensor 208 so that reflected light from the background part of the photosensitive body drum becomes a predetermined value.

Figure 6:
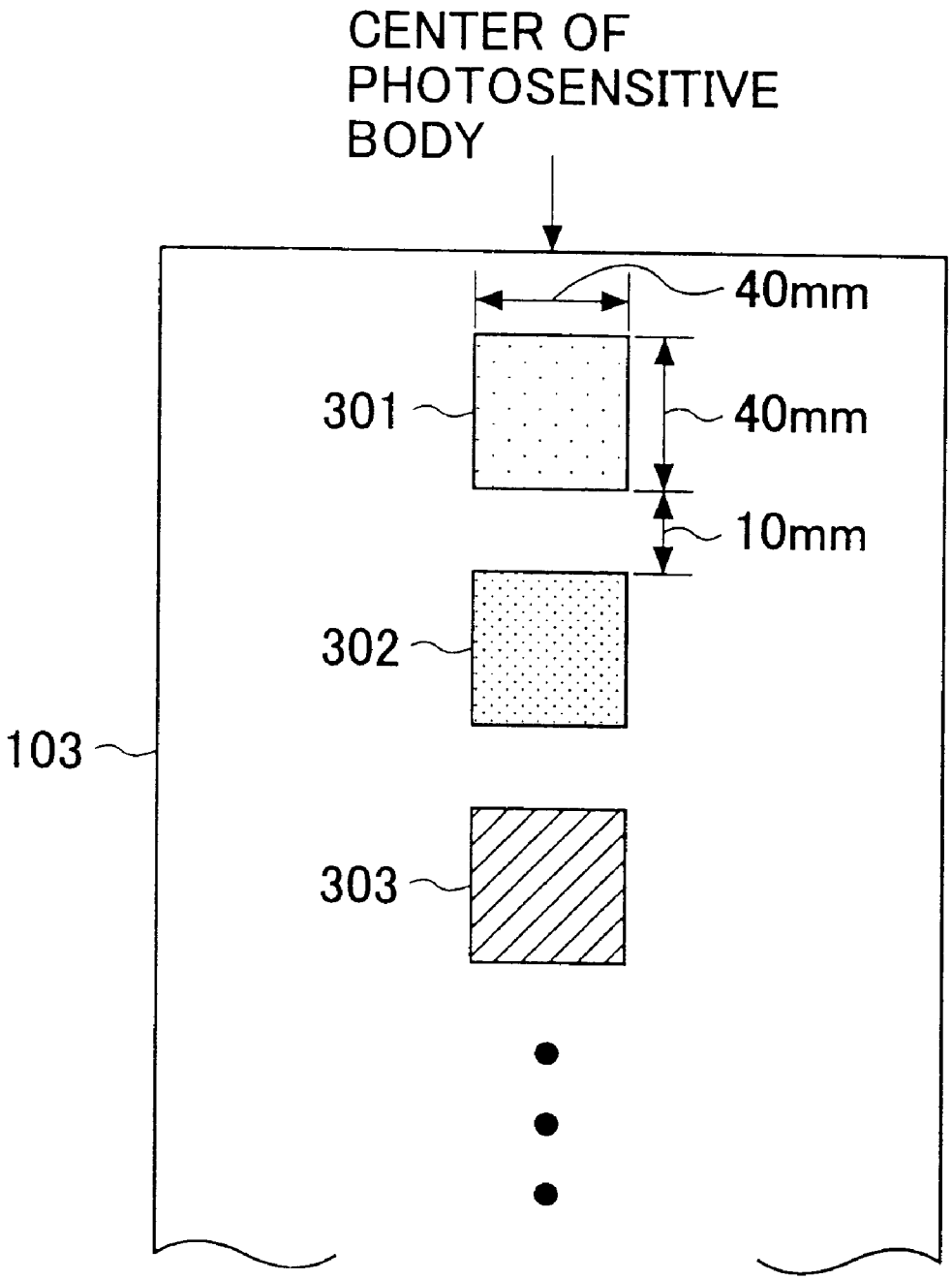
FIG. 6 illustrates N toner detecting patterns (first toner detecting pattern) formed on a photosensitive body drum shown in FIG. 1.

Then, the main control part 201 forms a latent image pattern (test pattern; first toner detecting pattern) on the photosensitive body drum 103 in a step S504. As shown in FIG. 6, electrostatic latent images having N different tone densities (N electrostatic latent image patterns) 301, 302, 303, . . . are formed on the photosensitive body drum 103 at predetermined intervals along a direction of rotation of the photosensitive body drum 103 at a center along a width direction of the photosensitive body drum 103.

For example, 10 rectangular latent image patterns 301, 302, 303, . . . having tone densities different from each other each having a rectangular shape having each side of 40 millimeters are formed at intervals of 10 millimeters for each color components.

Then, in a step 505, the output values of the surface electric potential sensor 211 for the electric potentials of these electrostatic latent images 301, 302, 303, . . . are read in, and are stored in the RAM 204.

Then, the main control part 201 visualizes the ten latent image patterns 301, 302, 303, . . . for four color components of black, cyan, magenta and yellow on the photosensitive body drum 103 in sequence at predetermined intervals Then, the main control part 201, in P sensor detection in a step 506, causes the BK developing device 106, C developing device 107, M developing device 108 and Y developing device 109 to develop the latent image patters 301, 302, 303, . . . for the four color components, respectively. Thus, the latent image patterns are visualized to be toner images of the respective color components, and, the output values of the reflection density sensor 208 for these toner images of the respective color components are obtained and stored in the RAM 204, as Vpi (i=1 through N) for each color component.

In this occasion, the main control part 201 causes the charger 104 to uniformly charge the photosensitive body drum 103, forms the latent image patterns 301, 302, 303, . . . with changing of the output of the laser optical system 105 through the laser optical system control unit 206, and visualizes these patterns. However, it is not necessary to be limited to this manner, and, it is also possible that, without causing the laser optical system 105 to change the output thereof, the developing electric potentials of the respective developing devices 106 through 109 are switched in visualizing the latent image patterns, instead.

Then, the main control part 201, in toner adhesion amount detection in a step 507, converts the output values of the reflection density sensor 208 stored in the RAM 204 into toner adhesion amounts for a unit area by referring to a table stored in the RAM 204. Then, steps 508 through 510 are executed. These steps will now be described in detail.

Figure 8:
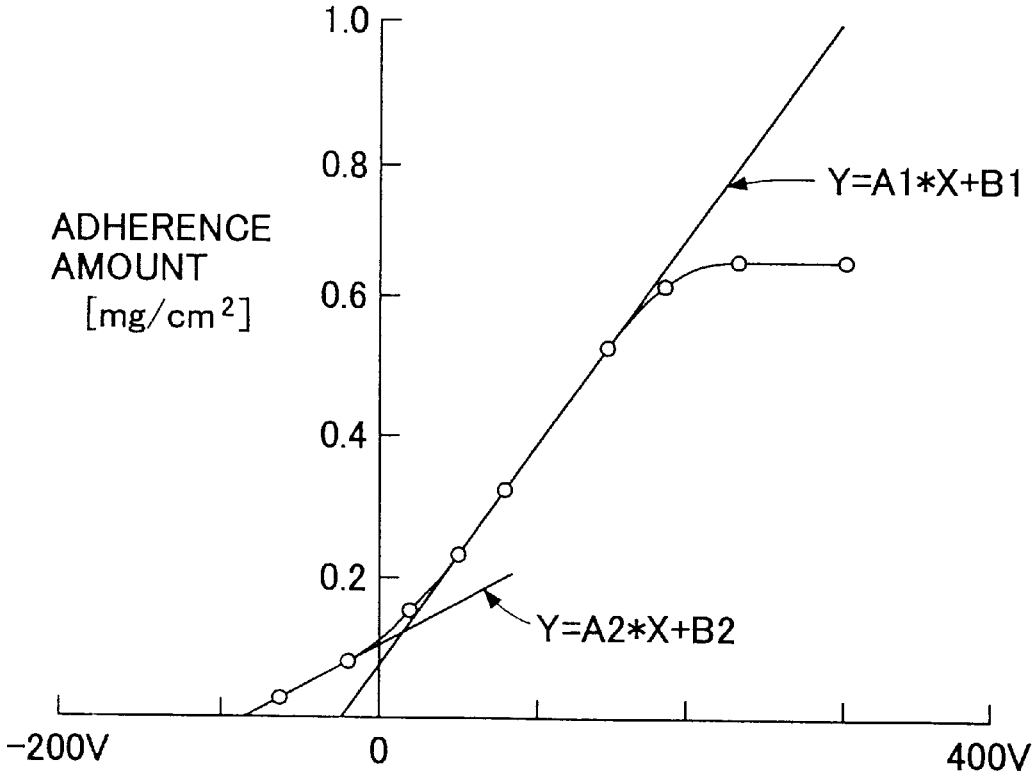
FIG. 8 shows characteristics of one example of relationship between a surface electric potential on the photosensitive body drum shown in FIG. 1 and toner adhesion amount.

FIG. 8 shows a graph in which a relationship between electric potential data obtained by the step 505 and the toner adhesion data obtained by the step 507 is plotted on an x-y plane for the respective latent image patterns. The x-axis represents a difference (VB−VD) between the electric potential, that is, the difference between the development bias electric potential VB and the surface electric potential VD on the photosensitive body drum 103, while the y-axis represents the toner adhesion amount (mg/cm$^2$).

An infrared light reflection sensor such as the reflection density sensor 208 in the present embodiment has a characteristic such as that shown in FIG. 8, and, for black, the sensor has a saturated characteristic for a much adhered part in which the toner adhesion amount is large. Accordingly, if the detection value of the reflection density sensor 208 obtained for the much adhered part were used as it is for calculating the toner adhesion amount, a value different from the actual adhesion amount would be obtained. Thereby, toner replenishment control performed based on the toner adhesion amount could not be performed accurately.

In order to solve this problem, the main control part 201 uses, for the latent image patterns for each color component, only a straight-line section of the relationship (γ characteristic of the developing device) between the electric potential Xn (n=1 through 10) of the latent image pattern and the toner adhesion data Yn is used, as will be described later, and, by applying a method of least squares for the data of this section, straight-line approximation is performed on the development characteristic of each developing device 106 through 109. Thus, for each color component, an approximated straight-line equation of the development characteristic is obtained, and, by using the approximated straight-line equation, control electric potentials for each color component is obtained.

The following equations are used for the method of least squares:

$$Xave=(\Sigma Xn)/k \tag{1}$$

$$Yave=(\Sigma Yn)/k \tag{2}$$

$$Sx=\Sigma\{(Xn-Xave)\times(Xn-Xave)\} \tag{3}$$

$$Sy=\Sigma\{(Yn-Yave)\times(Yn-Yave)\} \tag{4}$$

$$Sxy=\Sigma\{(Xn-Xave)\times(Yn-Yave)\} \tag{5}$$

where:

n=1 through k; and

Σ means summation for n=1 through k.

Assuming that the approximated straight line equation obtained from the data of the electric potentials of the latent image patterns and the toner adhesion amounts after the visualization obtained from the surface electric potential sensor 211 and reflection density sensor 208 is Y=A1·X+B1, the coefficients A1 and B1 can be expressed as follows by using the above-mentioned variables:

$$A1=Sxy/Sx \tag{6}$$

$$B1=Yave-A1\cdot Xave \tag{7}$$

Further, a correlation factor R of the approximated straight line equation is expressed by the following equation (8)

$$R\times R=(Sxy\times Sxy)/(Sx\times Sy) \tag{8}$$

In the present embodiment, the main control part 201, in the step 508, extracts the following six sets of the data Xn of the electric potentials of the latent image patterns and data Yn of the toner adhesion amounts after the visualization obtained from the surface electric potential sensor 211 and reflection density sensor 208: (X1 through X5, Y1 through Y5) (X2 through X6, Y2 through Y6), (X3 through X7, Y3 through Y7), (X4 through X8, Y4 through Y8), (X5 through X9, Y5 through Y9), (X6 through X10 Y6 through Y10), performs the straight line approximation, and calculates the correlation factors according to the above-mentioned equations (1) through (8). Thereby, the following 6 sets of approximated strength line equations and correlation factors (9) through (14) are obtained:

$$Y11=A11\times X+B11;\ R11 \quad (9)$$

$$Y12=A12\times X+B12;\ R12 \quad (10)$$

$$Y13=A13\times X+B13;\ R13 \quad (11)$$

$$Y14=A14\times X+B14;\ R14 \quad (12)$$

$$Y15=A15\times X+B15;\ R15 \quad (13)$$

$$Y16=A16\times X+B16;\ R16 \quad (14)$$

The main control part 201 selects one of the thus-obtained six approximated straight line equations, which has the maximum correlation factor of those R11 through R16, for each color component.

Figure 9:
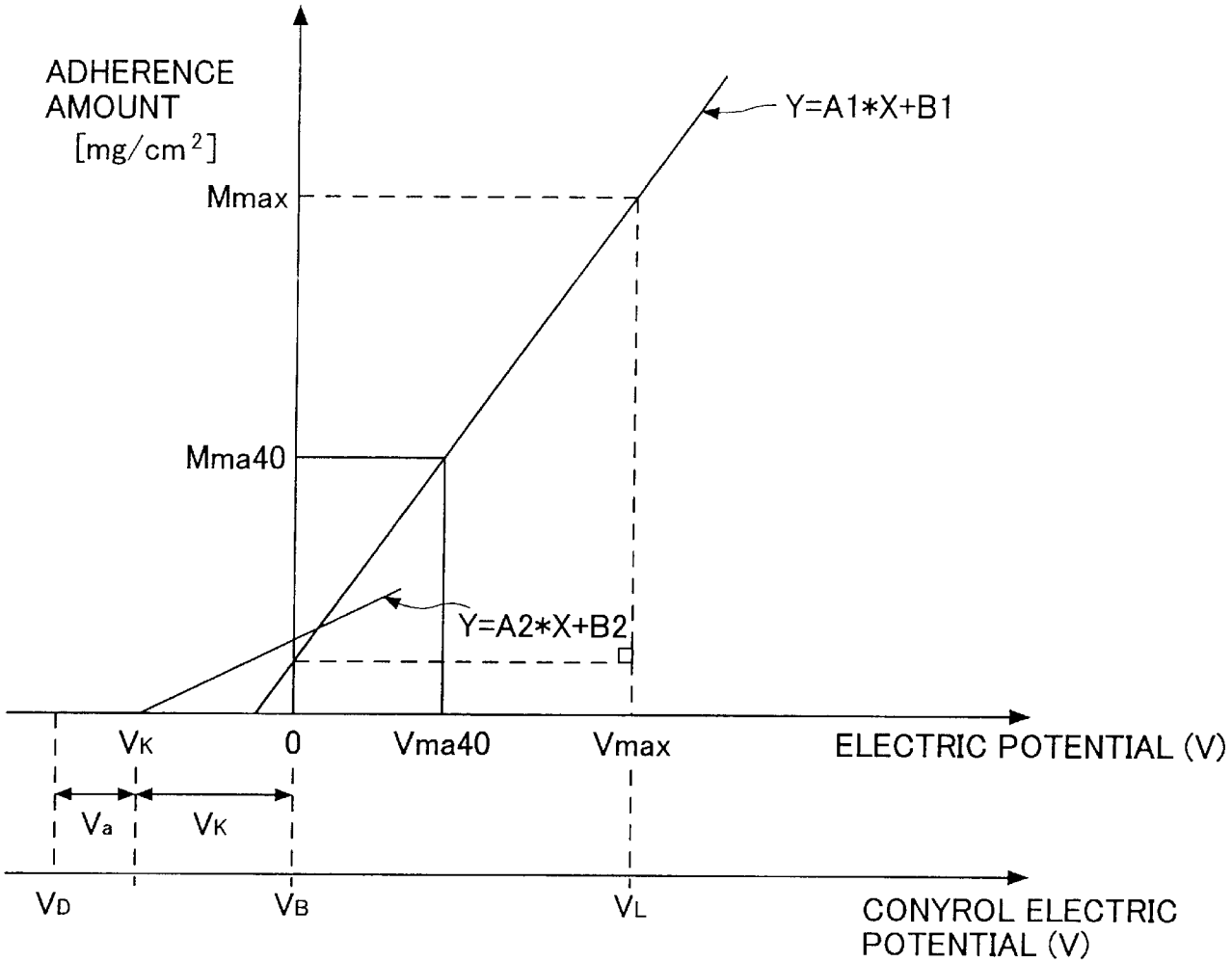
FIG. 9 illustrates one example of relationship between the surface electric potential on the photosensitive body drum shown in FIG. 1 and toner adhesion amount.

Then, the main control part 201, in a step 509, as shown in FIG. 9, calculates a value of x for a value of y corresponding to the necessary maximum toner adhesion amount Mmax, that is, the developing potential Vmax, and a value of x for a value of y corresponding to the toner replenishment control target value Mma40, that is, the developing potential Vma40, by the thus-selected approximated straight line equation, for each color component. Mma40 and Vma40 concerning the toner replenishment control will be described later.

The respective development bias electric potentials VB of the BK developing device 106, C developing device 107, M developing device 108, Y developing device 109, and the surface electric potentials (exposure electric potentials) VL of the image exposure for the respective color components on the photosensitive body drum 103 are obtained by the following formulas (15) and (16):

$$Vmax=(Mmax-B1)/A1 \quad (15)$$

$$VB-VL=Vmax=(Mmax-B1)/A1 \quad (16)$$

The relationship between VB and VL can be expressed by using the coefficients of the approximated straight line equation. Accordingly, the above-mentioned equation (16) becomes:

$$Mmax=A1\times Vmax+B1 \quad (17)$$

The relationship between the charged electric potential VD of the photosensitive body drum 103 and the development bias electric potential VB is obtained, from an x coordinate VK (development starting voltage of the developing device) at an intersection point between $$Y=A2\times X+B2 \quad (18)$$

and the x-axis, and an experimentally obtained background stain margin voltage $V_{\alpha}$, by the following equation (19):

$$VD-VB=VK+V\alpha \quad (19)$$

Accordingly, the relationship between Vmax, VD, VB and VL is determined from the equations (16) and (19).

In this embodiment, Vmax is used as a reference value, and the relationship between this value and each of the control electric potentials VD, VB and VL is obtained through experiment or the like, and is previously stored in the ROM 203 in a form of a table shown in FIG. 11.

The main control part 201, in a step 510, selects data from the above-mentioned table, having Vmax nearest to Vmax calculated as mentioned above for each color component, and, uses the respective control electric potentials VB, VD and VL of the thus-selected data as target electric potentials.

Then, in a step 511, the main control part 211 controls the laser light-emission power of the laser optical system 105 for the maximum luminous energy, through the laser optical system control unit 206, and detects a residual electric potential of the photosensitive body drum 103 by taking the output value of the surface electric potential sensor 211.

Then, in a step 512, when the thus-detected residual electric potential is not 0, the main control part 201 performs correction on the above-mentioned target electric potentials VB, VD and VL for the residual electric potential, and, adopts the thus-corrected values as the target electric potentials to be actually used.

Finally, in a step 513, the main control part 201 adjusts the power supply circuit 207 so that the charged electric potential of the photosensitive body drum 103 provided by the charger 104 becomes the above-mentioned target electric potential VD, adjusts the laser light-emission power of the laser optical system 105 through the laser optical system control unit 207 so that the exposed electric potential of the photosensitive body drum 103 becomes the above-mentioned target electric potential VL, and, also, adjusts the power supply circuit 207 so that the respective development bias voltages of the BK developing device 106, C developing device 107, M developing device 108 and Y developing device 109 become the above-mentioned target electric potentials VB, respectively.

Then, the charger grid voltage VG applied to the charger 104 is changed and adjusted so as to achieve the target electric potential of VD. Then, after VD is achieved, the laser power is adjusted so as to achieve the target electric potential of VL. Then, the charger grid voltage VG and laser power adjusting values obtained for the predetermined electric potentials are stored in the RAM 204.

These values are image production conditions for normal (regular) image forming operation which will be performed, and, also, image production conditions (Vg, Ld) for producing toner detecting patterns for toner replenishment control.

The toner replenishment control performed by the main control part 201 will now be described with reference to FIG. 4.

Figure 7:
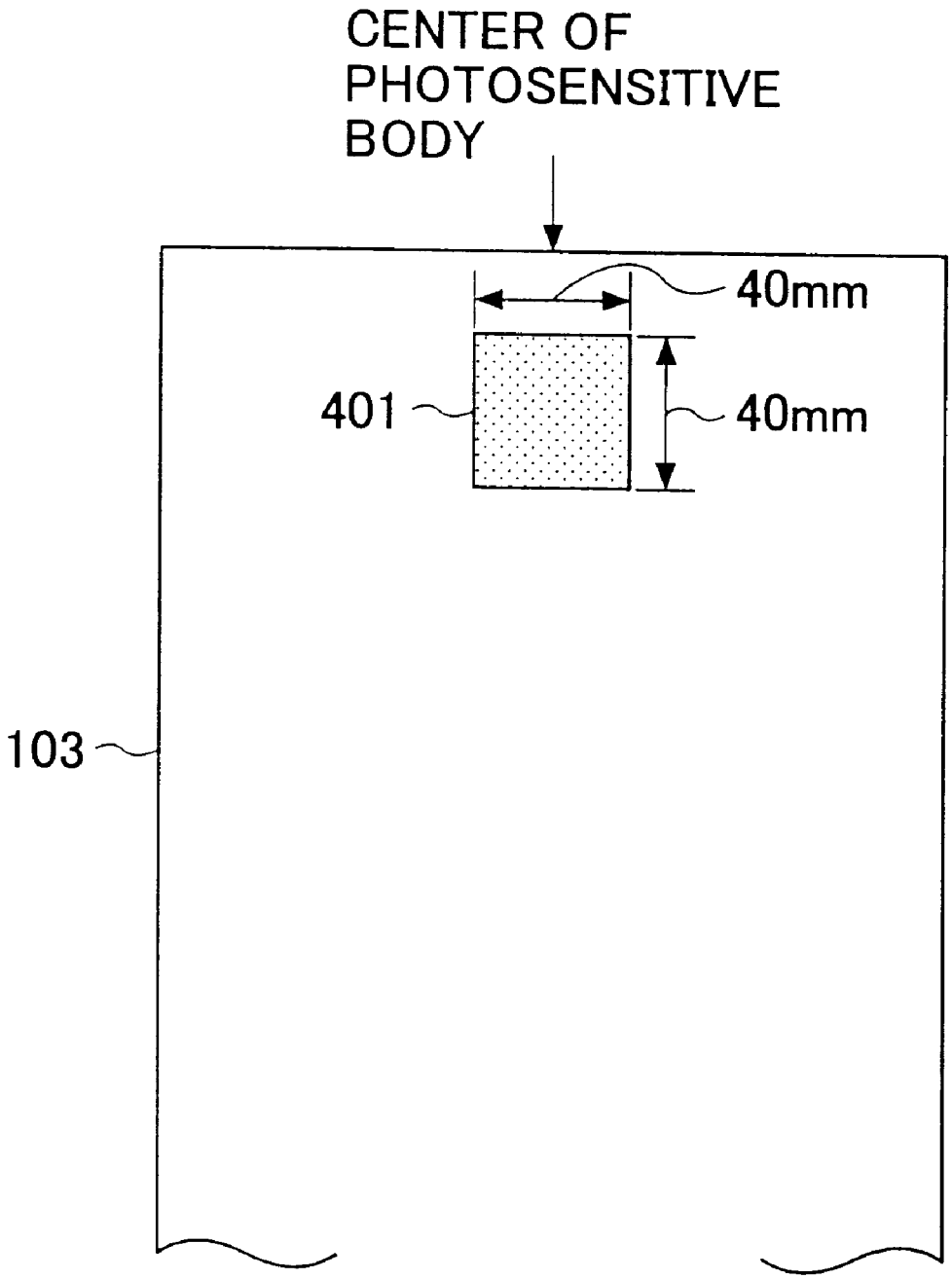
FIG. 7 illustrates a toner detecting pattern (second toner detecting pattern) formed on the photosensitive body drum shown in FIG. 1.

In latent image pattern formation in a step 601, VG and laser power determined by the above-mentioned electric potential control are used, and, similarly to the occasion of the electric potential control, as shown in FIG. 7, a latent image pattern (second toner detecting pattern) having one tone density (one latent image pattern) 401 is formed for each color component at a center along the width direction of the photosensitive body drum 103 every occasion of normal (regular) image formation (every copy) at a tail end of the regular image.

In the toner replenishment control in the present embodiment, as shown in FIG. 7, the rectangular latent image pattern 401 having each side of 40 millimeters having a predetermined tone density is formed for each color component with an interval of 10 millimeters from the tail edge of an image formed in an occasion of normal image formation, and, in a step 602, for each color component, the output value of the surface electric potential sensor 211 for the electric potential of the latent image pattern 401 is read, and is stored in the RAM 204.

Then, the main control part 201 visualizes the latent image patterns 401 for the four color components, black, cyan, magenta and yellow in sequence on the photosensitive body drum 103 with predetermined intervals.

What is important is the development potential used when the latent image pattern is developed. Through the above-mentioned electric potential control, electric potential control has been performed such that the density obtained in an occasion of normal image formation may be proper one. Therefore, basically, through the toner replenishment control, when conditions are satisfied such that the toner adhesion amount of the toner detecting pattern may be Mma40 which is the toner replenishment control target value (target toner adhesion amount: 0.4 mg/cm in the present embodiment), a difference between the toner replenishment control target value and the detection value is small, and, as a result, undesired extreme toner replenishment control is not performed. Thus, toner replenishment control is performed such that the image density during electric potential control may be maintained stably.

In the present embodiment, during the electric potential control, the development bias is set for each color component so that Vma40 obtained in the step 509 of FIG. 3 is the development potential, and, the latent image pattern 401 is developed by using the development bias.

For example, assuming that the data No. 5 of the above-mentioned table is selected, and, thus, Vma40 which is the development potential to obtain Mma40 is calculated as being 130 V, when the toner detecting pattern is produced by using the values Vg and Ld obtained based on the data thus selected from the electric potential table, and the −260 volts is obtained as the surface electric potential of the surface electric potential of this toner detecting pattern, this toner detecting pattern is developed immediately as a result of the development bias of −390 volts which includes the development potential of 130 volts being applied.

However, even when the development potential of 130 volts is used, there is a case where the resulting adhesion amount is not necessarily 0.40 (mg/cm$^2$) due to various factors, i.e., variation in approximation of the development γ characteristic, variation in power pack characteristic, and so forth, actually. Normally, in such a toner replenishment control system employing a toner adhesion amount detecting sensor, as the toner replenishment control is performed based on difference between a toner replenishment target value and a detected toner adhesion amount, the toner replenishment control may be performed in a more extreme manner as this difference becomes larger or such that no toner replenishment is made. As a result, the image density may vary extremely in an undesirable manner, or shortage in toner may occur.

Figure 4:
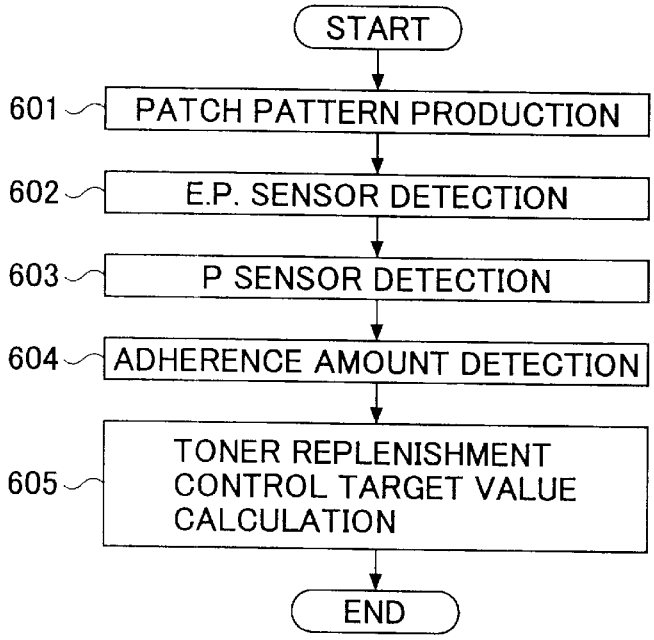
FIG. 4 shows a flow chart of calculating toner replenishment control target value performed by the main control part shown in FIG. 2.

In order to solve this problem, when the conditions for producing the toner detecting pattern are altered through the electric potential control, the toner adhesion amount is detected, and a new toner replenishment control target value is determined, as shown in FIG. 4.

In a flow shown in FIG. 4, steps 601 through 604 are the same as the steps 504 through 507 of FIG. 3. In this operation, according to the image production conditions for normal/regular image formation determined through the electric potential control of FIG. 3, the toner detecting pattern is produced, and, according to the toner amount detection result obtained therefrom, the toner replenishment control target value is corrected.

Figure 5:
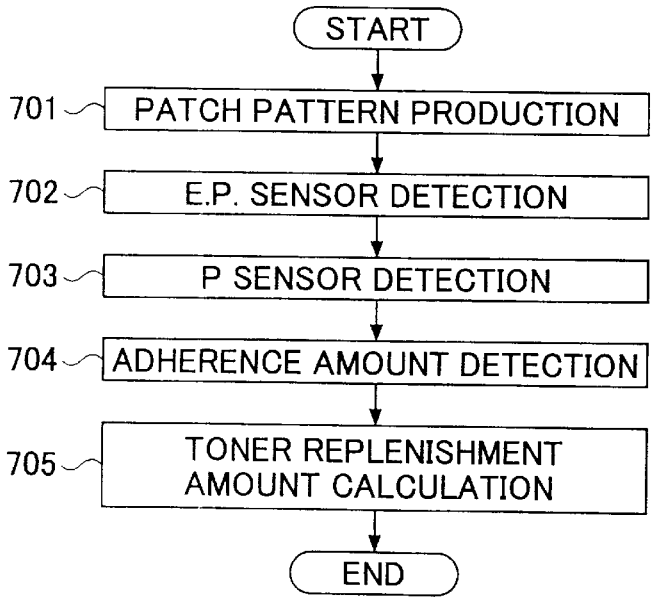
FIG. 5 shows a flow chart of calculating toner replenishment amount performed by the main control part shown in FIG. 2.

That is, after the electric potential control shown in FIG. 3, the calculation of the toner replenishment control target value shown in FIG. 4 is performed, and, in an occasion of normal/regular image formation, the toner replenishment control is performed based on a comparison result between the toner amount detection result obtained in the operation shown in FIG. 5 and the corrected new toner replenishment control target value obtained through the operation shown in FIG. 4. FIG. 7 shows the example of the toner detecting pattern as mentioned above. Thus, the toner detecting pattern is produced subsequent to the tail edge of the image formed in the normal image formation.

In the flow shown in FIG. 5, steps 701 through 704 are the same as the steps 504 through 507 shown in FIG. 3. In this operation, the toner detecting pattern is produced in a step 701 according to the image production conditions for normal/regular image formation determined through the electric potential control shown in FIG. 3, and, a toner replenishment amount (toner supply amount) is determined (step 705) according to a comparison result between the toner amount detection result obtained in steps 703, 704.

How to obtain the new toner replenishment control target values will now be described in detail.

When the above-mentioned electric potential control is performed, the toner detecting pattern is produced by using these conditions (Vd, Ld and Vb to achieve Vma40) therefor, and the toner adhesion amount thereof is detected.

For example, when the thus-obtained detection value of the toner adhesion amount (value) is 0.35 (mg/cm$^2$), the current toner replenishment control target value is replaced by 0.35 (mg/cm$^2$). Then, actual toner replenishment is performed with the following toner replenishment amount:

Tona1 (mg)=0, when:

$$(\text{target adhesion value})-(\text{detection adhesion value})<0;$$

Tona2 (mg)=60, when:

$$(\text{target adhesion value})-(\text{detection adhesion value})\geqq 0;$$

Tona3 (mg)=200, when:

$$(\text{target adhesion value})-(\text{detection adhesion value})>X\ (\text{mg/cm}^2)=50$$

Thereby, undesirable variation in image density due to a shift in toner adhesion amount caused by alteration of the image production conditions for producing the toner detecting pattern is avoided, and, after that, the toner replenishment control is performed such that 0.35 (mg/cm$^2$) may be maintained, and image density is prevented from varying extremely in an undesirable manner.

A second embodiment of the present invention will now be described.

In the second embodiment, differently from the above-described first embodiment, toner replenishment control is performed in accordance with the developing performance such that degradation of the developing performance due to aging may be avoided.

Specifically, in the second embodiment, in the step 509 of FIG. 3 of the electric potential control in the first embodiment, according to the development γ characteristic calculated for determining the development potential for the toner replenishment control, the development potential for the toner replenishment control is corrected, and, also, the toner replenishment control target value is corrected, as follows:

| Development γ Calculated Value (X) | X < 2.0 | 2.0 ≦ X ≦ 4.0 | X > 4.0 |
|---|---|---|---|
| Vma40 Correction Amount | −15 V | 0 | +15 V |
| Correction Amount for Toner Replenishment Control Target Value | detected toner adhesion amount +0.05 (mg/cm$^2$) | detected toner adhesion amount | detected toner adhesion amount −0.05 (mg/cm$^2$) |

Assuming that the calculated value of the development γ (corresponding to the inclination A1 of the above-mentioned approximated straight line equation) in the electric potential control is 1.8, which is smaller then 2.0 in the above table, Vma40 obtained in the electric potential control is corrected by −15 volts according to the table. As a result, assuming that the original Vma40 is 150 volts, the corrected Vma40 is 135 volts. By the development bias based on this condition, setting of the toner replenishment control target value is performed as in the first embodiment. However, in the second embodiment, when the detected toner adhesion amount obtained when the toner detecting pattern formed by 135 V is 0.320, for example, in order to gradually increase the development performance based on the detected value at this occasion, in the step 605 of FIG. 4, the toner replenishment control target value after the electric potential control is corrected by +0.05 (mg/cm$^2$) according to the above-mentioned table. Thus, the setting of the toner replenishment control target value is made as being 0.370.

Thus, according to the second embodiment, in a case where the measured development γ characteristic is low as mentioned above, when Vma40 is lowed intentionally in order to lower the detection value of toner adhesion amount of the toner detecting pattern, this detection value is lowed (steps 703, 704 of FIG. 5), and, thereby, the toner replenishment amount is determined based on the comparison result with the toner replenishment control target value (step 705). However, at this time, in order to prevent toner replenishment control from being performed extremely, the toner replenishment control target value is also lowed as mentioned above. Thereby, the control amount in the toner replenishment control is eased, and, as a result, toner replenishment is performed gradually. Thus, it is possible to avoid extreme variation in image density.

Further, in the second embodiment, restriction is made for the updated toner replenishment control target value. This is because the detectable range and detection accuracy of the reflection density detecting sensor 208 is regarded.

Figure 10A:
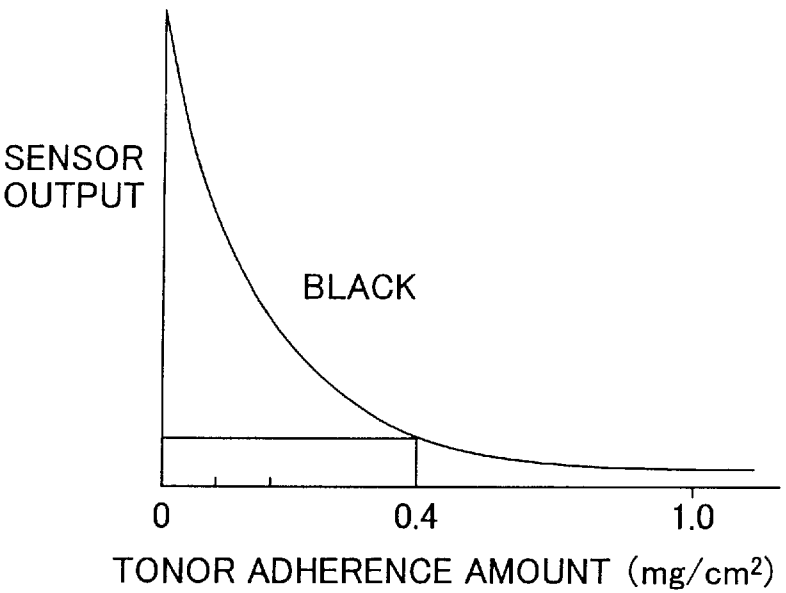
FIGS. 10A and 10B show an output characteristic of one example of detection for black by a reflection density sensor shown in FIG. 2, and the same for color, respectively.
Figure 10B:
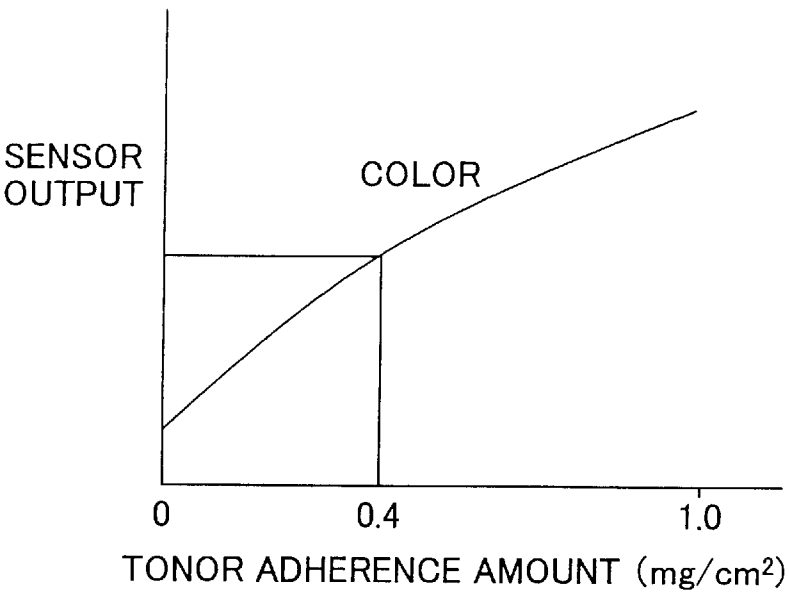

FIGS. 10A and 10B show examples of output characteristics for cases of detecting toner density for black and color. As shown in the figures, in the case of black, the sensitivity is extremely bad for more than 0.5 (mg/cm$^2$). Further, the detection accuracy is degraded for low adhesion range.

Therefore, in the second embodiment, the above-mentioned restriction is made, and, when the range of restriction is exceeded, the value nearest to the range is used as the toner replenishment control target value. Thereby, runaway/hang-up of toner replenishment control due to lack of proper toner adhesion detection is prevented, and, as a result, stable tone replenishment control can be performed.

Further, in the above-mentioned alteration of toner replenishment control target value, if the alteration was performed not based on actual toner adhesion detection value as in the related art, a resulting corrected value of Vma40 could not result in an expected toner adhesion amount, and, thereby, for example, a large difference in toner adhesion amount with respect to the target value might result in undesired extreme image density variation due to control being made such that the toner adhesion value may become the toner replenishment target value. However, according to the present invention, as the development performance is attempted to be corrected within a predetermined range of toner adhesion amount based on the current toner adhesion amount, remarkable undesirable image density variation does not occur, and, stable image formation can be achieved even through aging and/or environmental variation.

Further, by altering the correction range of the toner replenishment control target value based on the magnitude of (toner adhesion amount detection value of the toner detecting pattern)—(toner replenishment control target value before the correction), it is possible to make the setting in consideration of the current control situation. Thereby, it is possible to make more ideal setting of toner replenishment control target value.

Furthermore, in the above-described second embodiment, the above-mentioned table is used for the purpose of gradually correcting the development performance resulting in controlled image density variation. However, it is also possible to finely set a correction range according to the development γ performance/characteristic so that, for example, if the development γ performance/characteristic is low, the correction amount is increased.

Further, as correction of Vma40 is performed in the second embodiment as mentioned above, it is also possible to merely correct the toner replenishment control target value, without altering the image formation condition.

A third embodiment of the present invention will now be descried.

Basically, the third embodiment is the same as the above-described first embodiment. In the third embodiment, the toner detecting pattern for toner replenishment control has the same image production conditions as those of a predetermined density level in normal/regular image formation obtained in the electric potential control. Accordingly, in the step 509 of FIG. 3, the development potential, Vma40 for toner replenishment control is not calculated. Instead, by using Vg, Vb and Ld (for example, 700, 500 and 128 volts, respectively) determined for normal/regular image formation, the toner detecting pattern is produced for a specific writing value (in the present embodiment, 65/256). After that, the steps of obtaining the toner replenishment control target value based on the toner adhesion amount obtained from the initially produced toner detecting pattern are the same as those of the first and second embodiments.

Difference between the third embodiment and the first and second embodiments will now be described.

In the first and second embodiments, the development bias is altered from the case of regular image formation so that the toner adhesion amount becomes a predetermined value, or the development potential becomes a predetermined value. In contrast thereto, in the third embodiment, the development bias at the time of formation of the toner detection image is the same as that at the time of regular image formation, and, simply, writing is performed by a predetermined writing value. In the first and second embodiments, in order to make the development potential in image formation of the toner detection pattern a fixed value, it is necessary to perform feedback control for the development bias. For this purpose, the surface electric potential is detected by an electric potential sensor, and, by using the detection value, the development bias should be controlled by feedback control until this pattern is developed. In contrast thereto, in the third embodiment, as the surface electric potential at a toner detection pattern part should not be necessarily detected, the electric potential sensor is not necessarily needed. These differences relate to methods of forming the toner detecting pattern. Thus, the present invention can be applied for various methods of forming toner detecting patterns.

Thus, in the third embodiment, no alteration of image production conditions is made for the toner replenishment control in comparison to the first and second embodiments. Accordingly, a time required for performing feedback of the development bias for the toner detecting pattern is not needed, for example. Thereby, it is possible to shorten the length of the toner detecting pattern along the circumferential direction of the photosensitive body drum, and, thus, to reduce the consumption of the toner. Also, it is possible to improve the efficiency of image formation.

Furthermore, also for a system not employing an electric potential sensor, the same control can be performed by obtaining the development performance information from a relationship between writing value and toner adhesion amount.

Summarizing the features of the present invention, in a system in which image formation condition (charged electric potential, development bias, writing luminous energy and so forth) for toner detecting pattern is altered, in response to the alternation, the actual toner adhesion amount may vary more than an expected value, or may vary less than the expected value, in a problematic degree. According to the present invention, the toner adhesion amount is detected after the image formation condition for the toner detecting pattern is altered, and, then, based on the detected value and immediately preceding development performance (development y), a new toner replenishment control target value is set. Accordingly, it is possible to make resulting variation in toner adhesion amount nearer to the expected value. Furthermore, as described above, preferably, it is possible to make more ideal setting of toner replenishment control target value by altering the correction range of the toner replenishment control target value based on the magnitude of (toner adhesion amount detection value of the toner detecting pattern)—(toner replenishment control target value before the correction). Thereby, it is possible to achieve gentle correction regardless of the current situation.

Further, the present invention is not limited to the above-described embodiments, and variations and modifications may be made without departing from the scope of the present invention.

The present application is based on Japanese priority application No. 2000-227866, filed on Jul. 27, 2000, the entire contents of which are hereby incorporated by reference.

What is claimed is:

1. A toner replenishment control method for an image forming apparatus, comprising the steps of:

a) determining a second image production condition for a second toner detecting pattern based on a detection result of a toner adhesion amount of a first toner detecting pattern formed on an image carrying body according to a first image production condition;

b) performing toner replenishment control based on a detection result of a toner adhesion amount of the second toner detecting pattern formed according to the second image production condition determined by the step a), and a toner replenishment control target value; and c) altering the toner replenishment control target value to be used in the step b) based on the detection result of the second toner detecting pattern formed according to the second image production condition.

2. The method as claimed in claim 1, further comprising the step of d) correcting the alteration of the toner replenishment control target value in the step c) based on a current development performance.

3. The method as claimed in claim 1, wherein the toner replenishment control target value is determined to be within a range in which a toner adhesion sensor for detecting toner adhesion amount for the first and second toner detecting patterns can have a proper sensitivity.

4. The method as claimed in claim 1, wherein the image production condition for the second toner detecting pattern is the same as an image production condition for regular image formation performed.

5. A toner replenishing apparatus comprising:

a first part determining a second image production condition for a second toner detecting pattern based on a detection result of a toner adhesion amount of a first toner detecting pattern formed on an image carrying body according to a first image production condition;

a second part performing toner replenishment control based on a detection result of a toner adhesion amount of the second toner detecting pattern formed according to the second image production condition determined by said first part, and a toner replenishment control target value; and a third part altering the toner replenishment control target value to be used by said second part based on the detection result of the second toner detecting pattern formed according to the second image production condition.

6. The apparatus as claimed in claim 5, further comprising a fourth part correcting the alteration of the toner replenishment control target value performed by said third part based on a current development performance.

7. The apparatus as claimed in claim 5, wherein the toner replenishment control target value is determined to be within a range in which a toner adhesion sensor for detecting toner adhesion amount for the first and second toner detecting patterns can have a proper sensitivity.

8. The apparatus as claimed in claim 5, wherein the image production condition for the second toner detecting pattern is the same as an image production condition for regular image formation performed.

* * * * *